US005134256A

United States Patent [19]

Martin

[11] Patent Number: 5,134,256

[45] Date of Patent: Jul. 28, 1992

[54] PUFFER INTERRUPTER SWITCH

[75] Inventor: Donald R. Martin, New Lenox, Ill.

[73] Assignee: G & W Electric Company, Blue Island, Ill.

[21] Appl. No.: 608,232

[22] Filed: Nov. 2, 1990

[51] Int. Cl.[5] ..... H01H 33/82

[52] U.S. Cl. ..... 200/148 A; 200/148 B; 200/148 F

[58] Field of Search ..... 200/11 G, 11 J, 14, 200/17 R, 144 R, 148 A, 148 B, 148 F, 18; 335/8, 9, 10

[56] References Cited

U.S. PATENT DOCUMENTS

| | | | |
|---|---|---|---|
| 3,259,701 | 7/1966 | Neff, Jr. | 200/11 |
| 3,947,650 | 3/1976 | Strain et al. | 200/148 B |
| 4,268,890 | 5/1981 | Silbermann | 361/335 |
| 4,308,433 | 12/1981 | Edwards, Jr. | 200/5 R |
| 4,484,047 | 11/1984 | Olsen et al. | 200/148 F |
| 4,594,488 | 6/1986 | Talpo | 200/148 R |
| 4,910,367 | 3/1990 | Akers et al. | 200/148 A |

OTHER PUBLICATIONS

Siemens 8DJ10 Ring Main Units; Jan.-1986.

*Primary Examiner*—J. R. Scott

*Attorney, Agent, or Firm*—Laff, Whitesel, Conte & Saret

[57] ABSTRACT

An electrical switch apparatus comprising at least one set of contacts including a movable contact and a stationary contact, at least one chamber surrounding the contacts, a first support for supporting the chamber, a second support for supporting the stationary contact with respect to the chamber, an adhesive for attaching the first and second supports to the chamber, a non-circular drive shaft, a connection mechanism for coupling the moving contact to the drive shaft, a locating mechanism for securing the connection mechanism along the drive shaft, a coupling mechanism associated with the drive shaft for transmitting rotational energy to the drive shaft, the coupling mechanism having an adaptor that mates with the drive shaft with a clearance between the adaptor and the shaft, and a castable material filling the clearance to form an interface between the drive shaft and the adaptor.

19 Claims, 4 Drawing Sheets

28
58
66
26
56
24

33
75
26
74
68
70
80
80
72

45
40
30
44
41
26
28
82
78
32
78
C
86
88
33
84
B
C 82
70
78
26
82
32
78
68
33
34

26
68
32
70
80
33

PUFFER INTERRUPTER SWITCH

FIELD OF THE INVENTION

This invention relates to an electrical switching apparatus. More particularly, this invention relates to an apparatus and method for joining insulated and metallic components of a gas-insulating switch.

BACKGROUND OF THE INVENTION

A variety of applications exist for devices capable of switching high electric currents in electric power distribution systems. A common application in the United States and Canada for high- current switches is referred to as "load-break" service. In this application, the switch controls transmission of power from a supply circuit to a load circuit. Several load break switches, each having a separate load circuit associated therewith, may be connected in parallel to a single supply circuit in order to control power distribution to the several load circuits. A load circuit typically may receive power from one or two supply circuits, and would have a load break switch for controlling each of the connections between the load circuit and the supply circuits. The primary function of a load break switch is to control power distribution to loads, and although a load break switch may be capable of switching fault currents, fault handling is not the function of a load break switch. Some switches in load break service are operated relatively frequently.

Another common application for a high-current switch is "circuit breaker" service, in which the function of the switch is to control power during a fault condition. Such switches usually are capable of handling a fault current which far exceeds the normal operating current of the switch. Because circuit breaker switches are primarily used to interrupt fault currents, they may be operated very infrequently.

An application common in Europe for high-current switches is "ring-main" service. In that application, a load circuit is organized as a "ring" with power applied to the ring from a single supply circuit at a single place. Subsidiary load circuits are connected to the main load circuit at various points around the ring. Because the main load circuit is arranged as a ring, power can flow from the supply circuit to a subsidiary load in either direction along the ring, thereby minimizing the effect of an interruption at any point along the ring. Several ring main switches are inserted serially at various points along the ring to control the flow of power past those points. By opening any two switches in the ring, the segment of the ring between the switches may be isolated from the supply circuit without affecting loads on either side of the isolated segment. Switches used in ring main service generally have electrical characteristics similar to those of load break switches. Ring main configurations generally require a relatively large number of switches, in order to permit individual subsidiary load to be isolated.

Regardless of application, most high-current switches are subject to arcing and its attendant deleterious effects. Arcing can cause the contacts to erode and perhaps to disintegrate over time. In some atmospheres, the arc might cause an explosion. Therefore, a known practice is to fill the device with an inert, electrically insulating gas, such as sulphur hexafluoride ($SF_6$), which quenches the arcing.

In order to most efficiently quench the arc, it is often desirable to direct the insulating gas toward the region where the arc may form, and to increase the pressure of the gas. Directing the gas toward the arc zone at high velocity improves quenching by physically disrupting the conductive path formed by hot ionized particles which result from the arc. Increasing the gas pressure improves quenching by increasing the ionization potential of the gas. Providing a high-pressure, high-velocity stream of gas may be accomplished several ways. The stream may be supplied from an external high-pressure reservoir. Alternatively, means may be provided inside the switch to direct and compress an existing supply of gas as a function of the movement of the switch contacts themselves. Switches providing such means are commonly referred to as "puffer" switches. As the switch moves its contacts in an arc-causing motion, the gas is compressed. A jet or nozzle is positioned so that at the proper moment during contact movement, when the arc might be forming, a draft or blast of the compressed gas is directed toward the area of the arc, in effect "blowing out" the "flame" of the arc.

A variety of puffer switches are known including the following U.S. Pat. Nos.: 2,757,261; 3,214,550; 3,749,869; 3,947,650; 4,268,890; 4,484,047; 4,490,594; 4,523,235; 4,527,029; 4,659,886; European Patent Nos.: 0,171,352; 0,214,083; West German Patent Nos.: 1,290,223; 2,333,895; PCT application No. 89/11746; and other devices: Merlin Gerin Fluarc FB; Siemens 8DJ10 Ring Main Units. However, various structural problems are common in such prior art puffer switches.

One problem with the prior art puffer switches is that the drive system does not effectively translate the rotating energy of the operating mechanism to linear motion to move the switch contacts. A typical prior-art puffer switch includes one or more corresponding pairs of electrical contacts located in an enclosure having an atmosphere of insulating gas. One of each pair of contacts is stationary. The remaining "moving" contact is mounted for substantially linear translation between a "closed" position, in which it mechanically and electrically engages the stationary contact, and an "open" position, spaced a substantial distance from the stationary contact to prevent current flow between the contacts. Each pair of contacts is located within a cylindrical chamber for partially confining the insulating gas. An angularly rotatable actuator arm is provided to permit a user to operate the switch. The actuator arm drives an operating mechanism. The operating mechanism, in turn, drives an axially rotatable drive shaft, which is often cylindrically shaped. Operating levers mounted on the drive shaft convert the rotational motion of the drive shaft to linear motion for driving the moving switch contacts. Often, a separate pair of operating levers would be provided for each movable contact and the levers would be located at longitudinal positions along the drive shaft corresponding to the locations of the movable contacts. Proper rotational behavior requires that the operating levers do not slip or break from the drive shaft. Prior art operating levers mounted on a cylindrical shaft were subject to slippage when the shaft was axially rotated to open or close the contact switches. Additionally, when metal set screws were used in the prior art to mount the operating levers onto the cylindrical shaft, the set screws were subject to breakage.

Another problem with the prior art puffer switches was that the operating levers and the set screws holding the contacts were made from conductive materials, such as metal. Thus, because the metallic components were typically at ground potential and the switch contacts were at high potentials, there was the possibility for an arc to appear between the contacts and the operating levers or set screws. Nonmetallic materials, such as plastic, however, were often considered inadequate for attaching the operating levers to the cylindrical shaft of prior art switches due to the force generated from the sudden axial movement of the shaft when the contact switches are closed and opened. Consequently, random arcing problems in prior art switches, metallic components and other similar conductors were utilized because they minimized rotational problems attributal to breaking and slipping of the operating levers on the cylindrical shaft.

Another problem with the prior art switches was longitudinal slippage and imperfect alignment of the operating levers along the cylindrical shaft. These problems were attributed to the cylindrical design of the shaft which made proper attachment of the levers difficult.

A further problem with the prior art switches was substantial stress concentrations at the connection between the operating mechanism and the drive shaft. This problem is further exacerbated where the operating mechanism is metallic. Typically, the operating mechanism had a rotating plate for securing the drive shaft positionally and for transferring the rotational energy of the operating mechanism to the drive shaft This plate often did no effectively transmit its rotating motion to the shaft. One aspect of this problem was that in order to secure the drive shaft to the rotating plate, the attachment means apply sufficient force to crush or otherwise damage the drive shaft. Even if the shaft were not crushed, during switch operation, the plate could apply sufficient forces to the shaft to cause the shaft to deform at the point of contact, producing rotational tolerance errors. In addition, the tight coupling used between the plate and the drive shaft was intolerant of longitudinal stresses or displacements of the drive shaft. Where loose coupling was used between the plate and the shaft, the impact of the rotating plate would cause damage to the shaft, and the loose coupling also introduced rotational tolerance errors.

A further problem with prior art puffer switches was the mechanical arrangement for supporting the stationary contacts and for confining a quantity of insulating gas to be used to create the "puffing" effect. In some prior art switches, for example, an insulating base casting or base plate was used to support each of the cylindrical gas-confining chambers. Each chamber, in turn, supported an end cap, which was used to mount the stationary contact in the chamber. A problem confronting the designers of such switches was how to securely attach the chambers to the base casting and to the end caps. It is important for proper operation of the switch that the stationary contacts be securely held in a predetermined fixed position within the chamber, to ensure that current flows through appropriate regions of the contacts and so that contact is made or broken at the desired time. In many switches, a tie-rod type fastener system was used to compress the cylindrical chamber between the end caps and the base casting. In order to provide sufficient mechanical stability for this assembly, the tie-rod was adjusted to provide strong compressive forces. Because of the large compressive loads on the cylindrical chambers, a strong and relatively expensive material, such as polysulfone, was required for construction. This increased production costs.

OBJECTS AND SUMMARY OF THE INVENTION

Accordingly, an object of the invention is to provide a puffer switch with an improved drive system and drive coupling mechanism.

Another object of the invention is to provide a puffer switch having a drive system that effectively translates the rotating energy of the operating mechanism to the switch contacts.

Another object of the invention is to provide a puffer switch having a drive system that is completely insulated.

Another object of the invention is to provide a puffer switch that eliminates the need for metallic fasteners.

Another object of the invention is to provide a puffer switch that prevents random arcing.

Another object of the invention is to provide a puffer switch having a drive system that includes a mechanism that prevents longitudinal slippage and alignment problems of the operating levers along the drive shaft.

Another object of the invention is to provide a puffer switch having a stable mechanical connection between the end caps, cylindrical chambers, and base casting without the use of tie-rods or other fasteners which exert a large compressive load on the cylindrical chambers.

Yet another object of the invention is to provide a puffer switch having a drive coupling that eliminates stress concentrations and tolerance considerations by cushioning the interface between the drive shaft and the adaptor and in other adjacent parts of the switch.

Still another object of the invention is to provide a puffer switch that tolerates differences in the axial alignment of the drive shaft and the operating levers due to its inherent flexibility.

A further object of the invention is to provide a puffer switch with a simplified assembly of relatively low cost components.

The present invention, in the preferred embodiment, accomplishes the foregoing objects by providing an apparatus that comprises, in part, an insulating drive system in which insulating operating levers are fixed to a square insulating drive shaft by a lever locating mechanism. The levers each have a hole in one end which mate with the outer dimensions of the square tube. The locating mechanism consists of a flat insulating piece with a pair of notches in one edge which interface with the levers and locate the levers relative to each other along the shaft. The locating mechanism is fixed to the shaft by an insulating rivet.

The apparatus also comprises a drive coupling mechanism in which the square insulating shaft is mated to a metallic adaptor and wherein a flexible material is applied to the interface between the shaft and the adaptor. The use of a flexible material eliminates various problems, including the wearing or crushing of the shaft which is associated with a loose fit between the rotating plate and the shaft and the collapsing of the shaft due to an elevated torque which was produced by a tight fit between the plate and shaft.

The apparatus further comprises an adhesive for mechanically attaching the end caps, cylindrical chambers, and base casting of the switch. The adhesive attachment provides structural stability without the use of tie-rods or other fasteners which exert a large compressive load on the cylindrical chambers. This permits the use of less expensive construction materials.

BRIEF DESCRIPTION OF THE DRAWINGS

The inventive device will become apparent from the following description taken in conjunction with the attached drawings illustrating a preferred embodiment wherein.

DETAILED DESCRIPTION OF THE INVENTION

Figure 1A:
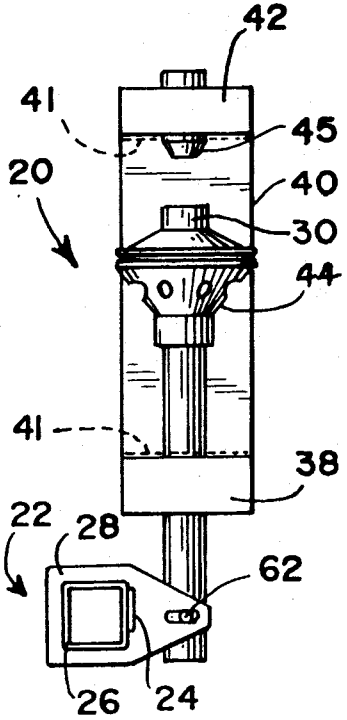
FIG. 1A is side elevational view of the inventive puffer switch assembly shown in FIG. 1.
Figure 1:
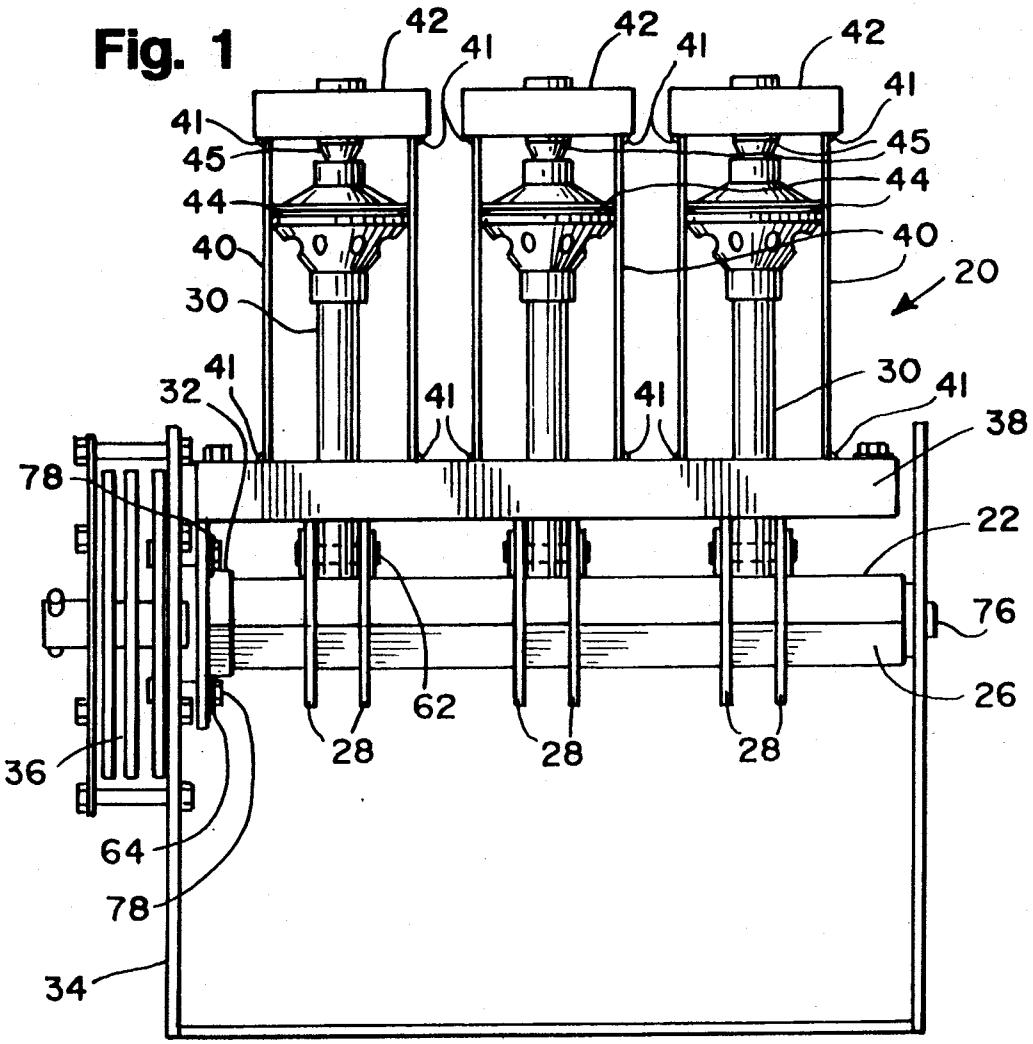
FIG. 1 is a cross-sectional view of the inventive puffer switch assembly.

Referring first to FIGS. 1 and 1A, the invention provides a puffer switch assembly generally denoted by the numeral 20 having, in part, a completely insulated drive assembly 22 which includes at least one lever locator 24 (see FIG. 2) that is attached to and is located longitudinally along shaft 26 and which secures a pair of operating levers 28. The assembly 20 is preferably located in a tank-like vessel (not shown) for containing an atmosphere of insulating gas, such as sulfur hexaflouride ($SF_6$). In the preferred embodiment, shaft 26 includes three lever locators 24. A movable contact 30 is retained by each pair of operating levers 28. As shown most clearly in FIG. 1, assembly 20 further includes a coupling mechanism 32 which is fastened to the interior of module housing 34 and into which is mounted an end of shaft 26. An operating mechanism 36 is located adjacent to shaft 26 and on the exterior of module housing 34.

A base casting or first support means 38 is located above operating levers 28 and extends across the upper portion of modular housing 34. The base casting 38 supports a set of rigid, generally transparent cylindrical chambers 40 which define a region for partially confining the insulating gas (such as sulphur hexaflouride [$SF_6$]) used to extinguish any arcs which may form. Housed within each of chambers 40 is movable contact 30, a puffing nozzle 44 and an associated stationary contact 45. A set of end plates or second support means 42 are located at the top of each of the chambers 40 for supporting the stationary contacts. The cylindrical chambers 40 are preferably constructed from an inexpensive thermoplastic material such as polycarbonate.

The first and second support means 38 and 42 are preferably cast from an appropriate insulating epoxy or other casting material. Because end plates 42 touch stationary contacts 45, they may be exposed to high temperatures, and the material used should therefore be a thermosetting or other heat-impervious material. The support means 42 and 38 are preferably attached to chambers 40 using a suitable adhesive 41. The adhesive 41 is preferably a high strength, primerless, two-part modified epoxy-based structural adhesive 41, such as Fusor 310, which is manufactured by Lord Chemical Products of Erie, Pa. The use of an adhesive 41 to secure the bulkheads 42 and 38 to chambers 40 eliminates the need for the insulating tie-rod assemblies of the prior art, thereby substantially reducing manufacturing costs. Because the adhesive assembly eliminates the need for tie rods, the cylindrical chambers 40 need not support a large compressive load. Accordingly, the chambers 40 may be constructed of relatively inexpensive polycarbonate, rather than the comparatively expensive polysulfone material used in some prior art switches.

Figure 2:
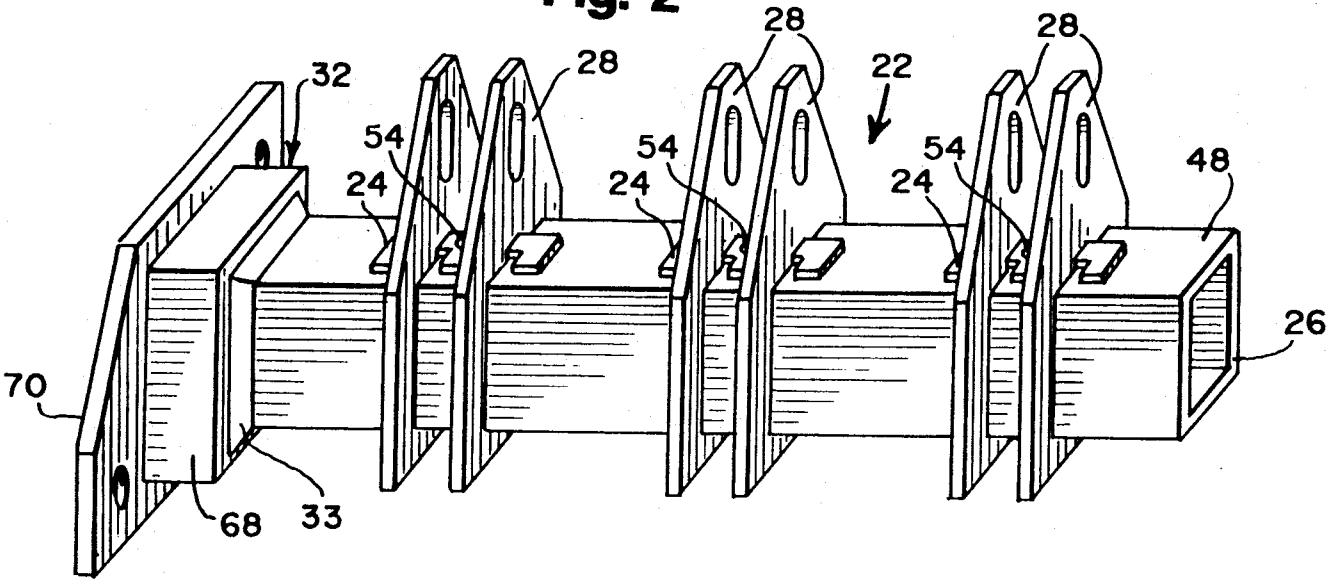
FIG. 2 is a perspective view of the inventive drive assembly shown in FIG. 1.
Figure 3:
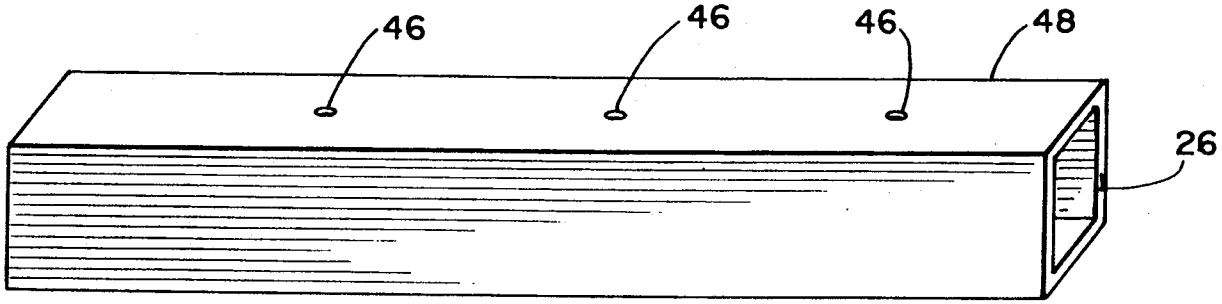
FIG. 3 is a perspective view of the shaft of the assembly shown in FIG. 2.

The shaft 26 is illustrated in FIGS. 1-3 as an elongated tube of square cross-section with a hollow interior. Shaft 26 is preferably constructed of an appropriate sturdy insulating material, such as a polyester resin filled with a non-woven mat of glass fibers. The shaft 26 may be formed using conventional techniques, such as pultrusion. Shaft 26 includes a plurality of openings 46 at selected locations along the longitudinal axis of its top side 48. Openings 46 provide a means to attach lever locator 24 and operating levers 28 to shaft 26.

Figure 4:
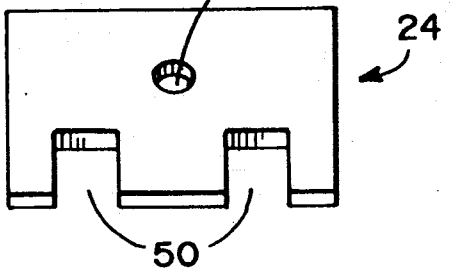
FIG. 4 is a perspective view of the inventive lever locator of the drive assembly shown in FIG. 2.
Figures 8, 9, 10, 11, 12:
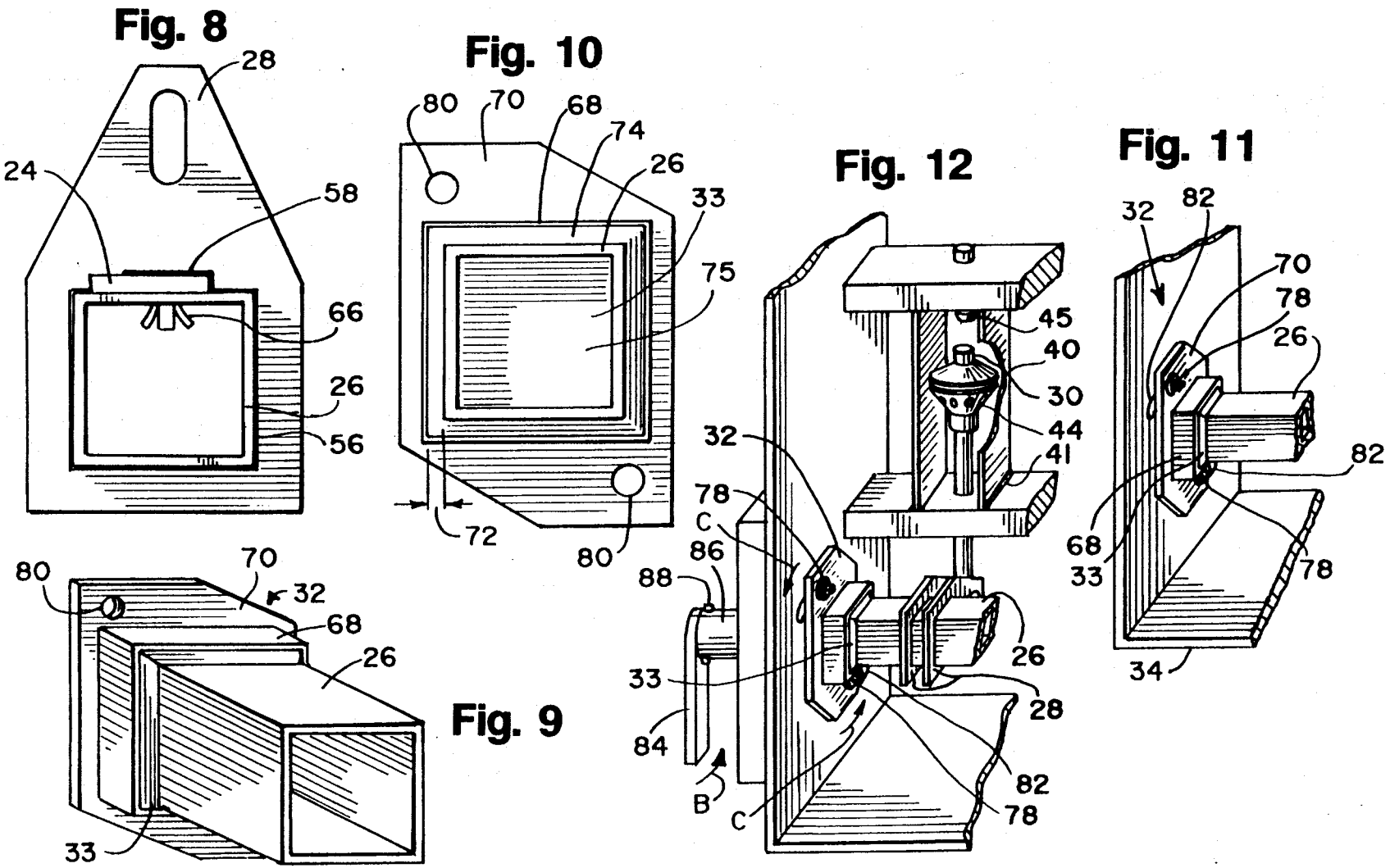
FIG. 8 is a cross-sectional view of the operating levers and lever locator as mounted on the shaft shown in FIG. 7.
FIG. 9 is a perspective view of the inventive coupling mechanism of the drive assembly shown in FIG. 2.
FIG. 10 is a cross-sectional view of the coupling mechanism of FIG. 9 and of the flexible attachment material applied therein.
FIG. 11 is a fragmented perspective view illustrating the coupling mechanism of FIG. 9 and the shaft as mounted on the module housing.
FIG. 12 is a fragmented perspective view illustrating the mode of operation of the inventive coupling mechanism and drive assembly of FIG. 2.

Lever locator 24 (FIGS. 2, 4) is a flat insulating piece that is adapted to secure and align a pair of operating levers 28 to shaft 26 at predetermined intervals corresponding to the locations of moving contacts 30 (FIGS. 1,12). Lever locator 24 includes a pair of notches 50 along one edge which interface with an interior portion of operating levers 28. A hole 52 is provided in the center of lever locator 24 for attaching the lever locator to shaft 26 by a drive rivet 54.

Figure 5:
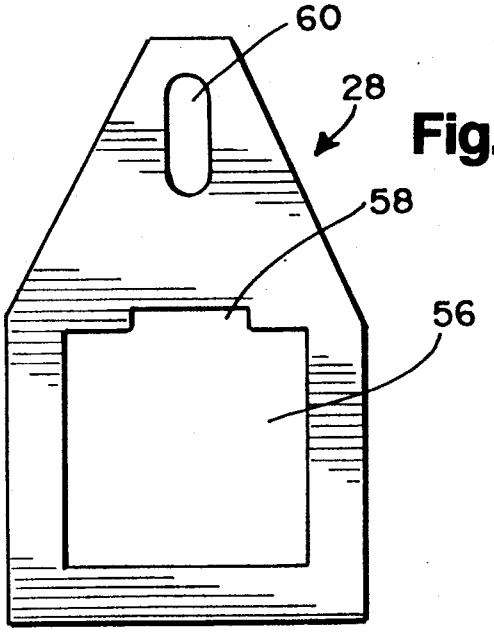
FIG. 5 is a plan view of the inventive operating lever of the drive assembly shown in FIG. 2.

Operating levers 28 (FIGS. 2, 5) are flat insulating pieces that correspond to and interconnect with lever locators 24 and which are adapted to slide axially onto shaft 26. Operating levers 28 include a primary opening 56 and an adjoining secondary opening 58 which receive and retain shaft 26 and lever locator 24, respectively. The dimensions of primary opening 56 and secondary opening 58 of operating levers 28 correspond to the outer dimensions of shaft 26 and lever locator 24, respectively, to create a close fit between the parts. The combined profile of square shaft 26 and lever locator 24, and the matching interior shape of operating levers 28, interfere such that once installed, operating levers 28 are fixedly secured to and cannot rotate with respect to shaft 26. Although shaft 26 has been described herein as "square", the shaft 26 may be of any non-circular or keyed geometry such that the operating levers are rotationally fixed with respect to the shaft.

The interference geometry of the shaft and operating levers eliminates the need for conventional fasteners for rotationally securing the operating levers to the shaft. In devices having a circular shaft, screws or rivets would be used for this purpose. However, the use of such fasteners is generally undesirable because the fastener is required to accept a large load in shear, and therefore must be constructed of strong material such as metal which can cause random arcing. A clamp-type fastener could also be used with a round shaft, but these are undesirable because they may be subject to slippage and require a tight fit around the shaft which could crush the shaft.

Operating lever 28 includes a third opening 60 which is located adjacent the end opposite the primary and secondary openings, 56 and 58, and is adapted to receive a pin 62 (see FIG. 1) for retaining movable contact 30 between the operating levers 28.

Figure 6:
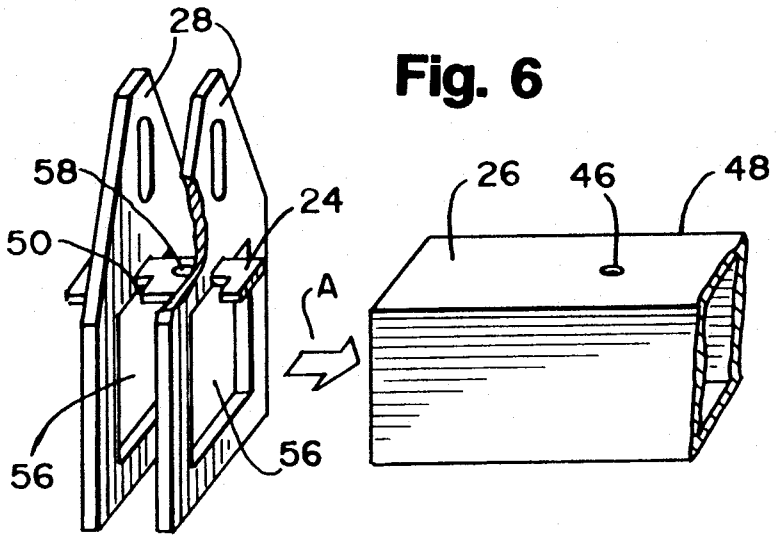
FIG. 6 is a perspective view of the inventive lever locator and operating levers being mounted onto the inventive shaft of the drive assembly shown in FIG. 2.
Figure 7:
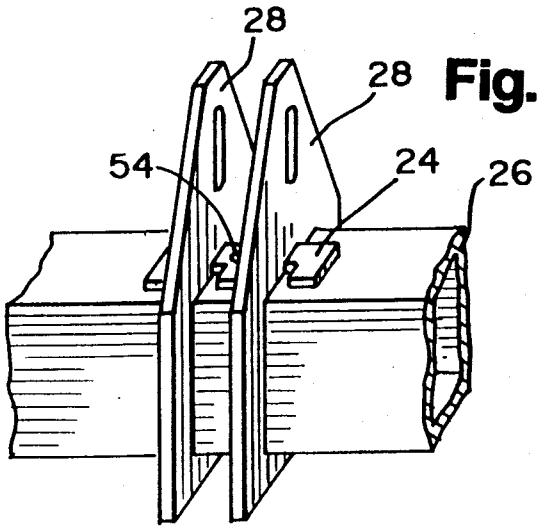
FIG. 7 is a fragmentary perspective view of the mounted lever locator and operating levers of FIG. 6.

FIG. 6 shows the method for attaching lever locator 24 and operating levers 28 to shaft 26. Initially, lever locator 24 is inserted into primary opening 56 of operating lever 28 until notch 50 of locator 24 is aligned with and positioned in opening 56 Lever locator 24 and the attached operating levers 28 are then slid onto one end of shaft 26, in the direction indicated by arrow A in FIG. 6, until hole 52 of lever locator 24 is aligned with opening 76 of shaft 26, as shown in FIG. 7. A drive or pop rivet 54 is then inserted through openings 46 and 52 of shaft 26 and lever locator 24, respectively. The bottom 66 of rivet 54 expands outwardly and retains rivet 54 on shaft 26 (see FIG. 8).

In order to provide rapid movement of the switch contacts, rotational mechanical energy supplied by a user via an operating handle is temporarily stored in the switch operating mechanism 36. As the operating handle (not shown) rotates past a predefined threshold, the operating mechanism 36 rapidly rotates an internal member (not shown) to transmit the stored energy to the switch contacts. A coupling mechanism 32 (FIGS. 9–10) is provided to transfer the rotational energy from the operating mechanism internal member to shaft 26. The coupling mechanism 32 includes a back plate 70, and a socket 68 into which one end of shaft 26 is mounted. As described further in greater detail, back plate 70 is operatively connected to the rotating internal member of operating mechanism 36 by bolts 78. Socket 68 is hollow and protrudes from and is integrally molded with back plate 70. Shaft 26 is inserted into the hollow of socket 68. Accordingly, socket 68 may be considered an "adaptor," because it adapts the square tube structure of the shaft 26 to the flat plate structure of coupling mechanism back plate 70.

The dimensions of shaft 26 and socket 68 are such that after shaft 26 has been inserted into socket 68 there is a clearance between the exterior of shaft 26 and the interior of socket 68, as indicated by numeral 72 in FIG. 10. Clearance 72 is filled with a castable material 33, which forms an interface 74 between insulating shaft 26 and socket 68 of coupling mechanism 32. The castable material 33 further spreads beneath the edges of shaft 26 in contact with back plate 70 to fill the interior 75 of shaft 26.

The castable material 33 described herein may be any appropriate casting material 33 compatible with the materials from which shaft 26 and socket 68 are constructed. Preferably, the castable material 33 cures quickly at room temperature, although materials which require only slightly elevated curing temperatures could be used. In its cured state, the castable material 33 is preferably relatively "flexible" compared to the stiffness of the materials used to construct shaft 26 and socket 68. However, it is not necessary for the castable material 33, to be noticeably soft to human touch. It is sufficient that the material be capable of some elastic deformation while remaining stable when loaded in compression. Suitable materials are polyurethane or room-temperature-curing casting-type epoxys.

The flexible castable material 33 transfers rotational force from socket 68 to shaft 26. In the above-described novel configuration, because socket 68 and shaft 26 have corresponding keyed or non-circular cross-sections, the castable material 33 is loaded in compression, rather than in shear (as would be the case if the cross-sections were circular). Therefore, the relative flexibility of the castable material 33 (as compared to the materials from which socket 68 and shaft 26 are constructed), causes the force exerted by socket 68 to be substantially evenly distributed across the entire portion of the exterior surface of shaft 26 which contacts the castable material 33. Without the castable material according to the present invention, less than all of the exterior surface of shaft 26 would com into direct mechanical contact with the inside surfaces of socket 68. As a result, the large mechanical force which socket 68 exerts on shaft 26 would be highly concentrated at those regions of direct contact. Since shaft 26 is preferably constructed of an insulating material, and since that material is relatively soft, the highly concentrated forces would tend to crush or abrade the material from which the shaft 26 is constructed. In addition, without the castable material 33, if any clearance were provided between shaft 26 and socket 68, the socket 68 would shift with respect to the shaft 26 during operation until the socket 68 was firmly seated against the shaft. This shifting would cause abrasion of the shaft and socket regardless of the materials from which they were constructed. Accordingly, the castable material 33 advantageously eliminates concentrations of forces on small regions of shaft 26 which could crush or deform the shaft. In addition, because the castable material 33 fills the interior 75 of shaft 26, the material resists inward flexure of the walls of the shaft, thereby further reducing potential damage to the shaft. A further advantage of the inventive configuration is that the exact size of the clearance 72 between shaft 26 and socket 68 is not critical. Therefore, the dimensions of shaft 26 and socket 68 need not be as precisely maintained as would otherwise be required, and manufacturing costs are reduced.

Shaft 26 and coupling mechanism 32 are secured to the interior of module housing 34 on one side by a bearing plug 81 and to the other side by at least one threaded bolt 78 and washer 64 (see FIG. 1). FIG. 11 shows coupling mechanism 32 as it appears mounted on modular housing 34. Bolt 78 is inserted through hole 80 (FIG. 9) of back plate 70 and into a pair of elongated diametrically opposed openings or slits 82 which are located on module housing 34. Bolt 78 is also threaded into an opening (not shown) in operating mechanism 36 (see FIG. 1).

The operation of the inventive puffer switch is best illustrated in FIG. 12 which shows shaft 26 as mounted on coupling mechanism 32. Movable contact 30 and stationary contact 45 are shown inside of chamber 40 in an open position. An actuator arm 86 is connected to lever 84 by nipples 88 and to shaft 26 by a bolt (not shown). To close the contacts, lever 84 is moved in the direction indicated by the arrow B. The rotational mechanical energy supplied by the user via an operating lever 84 is temporarily stored in the switch operating mechanism 36. As the operating lever 84 rotates past a predefined threshold, the operating mechanism 36 rapidly rotates an internal member 84 to transmit the stored energy to the shaft 26. Rotational movement of shaft 26 likewise causes coupling mechanism 32 to rotate in slits 82 in the direction indicated by the arrows C. As mechanism 32 and shaft 26 rotate, operating levers 28 move upwardly and cause movable contact 30 to contact stationary contact 45. To open the contacts, lever 84 is moved in the opposite direction and the same sequence of events occurs in reverse. During the opening of the contacts, the insulating gas is discharged at high speed from one or more openings located in nozzle 44 to extinguish the arc.

The inventive puffer switch design advantageously permits optimization of material choices for improved performance and cost over previous designs. The operating levers 28 and lever locators 24 are preferably constructed of an appropriate sturdy insulating material which can be inexpensively formed by conventional techniques, such as stamping. In addition. because the operating levers 28 touch contacts 30, these levers may be exposed to high temperatures. Therefore, it is preferred that the levers be constructed of a thermosetting material. NEMA G-10 epoxy glass laminate meets these constraints.

Switch assembly 20 has not been described in terms of approximate measurements of the various components, as it should be understood that the size of assembly 20 and its respective components may vary according to need.

Thus, a novel puffer switch has been disclosed which provides an improved mechanism for coupling mechanical operating energy from the switch operator to the contacts and an improved attachment between the base casting, end caps, and cylindrical chambers.

Therefore, it should be recognized that, while the invention has been described in relation to a preferred embodiment thereof, those skilled in the art may develop a wide variation of structural details without departing from the principles of the invention. Therefore, the appended claims are to be construed to cover all equivalents falling within the true scope and spirit of the invention.

The invention claimed is:

1. An electrical puffer switch apparatus comprising:

at least one set of contacts including a movable contact and a stationary contact;

at least one chamber surrounding said contacts;

first support means secured within said switch apparatus for supporting said chamber in a fixed position relative to said contacts;

second support means secured within said switch apparatus for supporting said chamber and said stationary contact in a fixed position within said chamber;

adhesive means for attaching said first and second support means to said chamber;

a non-circular drive shaft supported in spaced relation to said chamber and said stationary contact for rotational movement;

connection means for coupling said moving contact to said drive shaft;

locating means for securing said connection means along said drive shaft;

means associated with said drive shaft for transmitting rotational energy to said drive shaft, said means having an adaptor that mates with said drive shaft with a clearance between the adaptor and the shaft; and a castable material filling said clearance to form an interface between the drive shaft and the adaptor.

2. The electrical switch apparatus of claim 1 wherein said locating means are flat insulating pieces having a pair of notches which interface with the connection means.

3. The electrical switch apparatus of claim 1 wherein the connection means are flat insulating pieces having a primary opening and a secondary opening which are adapted to fit over the locating means and the drive shaft when the locating means are attached to the drive shaft.

4. The electrical switch apparatus of claim 1 wherein said castable material is a polyurethane.

5. The electrical switch apparatus of claim 1 wherein a cross-section of said non-circular drive shaft is square.

6. The electrical switch apparatus of claim 1 wherein said non-circular drive shaft is hollow.

7. The electrical switch apparatus of claim 6 wherein said hollow drive shaft is filled with castable material in the area where said drive shaft and said adaptor mate.

8. The electrical switch apparatus of claim 1 wherein a drive rivet is used to attach the locating means to the drive shaft.

9. An electrical puffer switch apparatus comprising:

at least one moving switch contact;

a non-circular drive shaft that is associated with said moving switch contact and supported in said switch apparatus in spaced relation to said moving contact for rotational movement;

connection means secured to said drive shaft and to said moving switch contact for coupling said moving switch contact to said drive shaft; and locating means for securing said connection means along the drive shaft, said locating means and said drive shaft cooperating to provide an interfering fit with said connection means, said connection means fitting over said locating means and said drive shaft.

10. An electrical puffer switch apparatus comprising:

at least one moving switch contact;

a non-circular shaft that is associated with said moving switch contact and supported in said switch apparatus in spaced relation to said moving contact for rotational movement;

connection means secured to said drive shaft and to said moving switch contact for coupling said moving switch contact to said drive shaft; and locating means for securing said connection means along the drive shaft, said locating means and said drive shaft cooperating to provide an interfering fit with said connection means, said connection means fitting over said locating means and said drive shaft; and said connection means comprising flat insulating pieces having a primary opening and a secondary opening which are adapted to fit over said locating means and said shaft when the locating means are attached to the drive shaft.

11. An electrical puffer switch apparatus comprising:

at least one moving switch contact;

a non-circular shaft that is associated with said moving switch contact and supported in said switch apparatus in spaced relation to said moving contact for rotational movement;

connection means secured to said drive shaft and to said moving switch contact for coupling said moving switch contact to said drive shaft; and locating means for securing said connection means along the drive shaft, said locating means and said drive shaft cooperating to provide an interfering fit with said connection means, said connection means fitting over said locating means and said drive shaft; and said connection means comprising flat insulating pieces having a pair of notches which interface with the connection means.

12. The electrical switch apparatus of claim 9 wherein the drive shaft is hollow.

13. An electrical switch apparatus with at least one movable contact comprising:

a drive shaft that is associated with said movable contact and which imparts movement to said contact, said drive shaft supported in said switch apparatus in spaced relation to said movable contact for rotational movement;

means for transmitting rotational energy to said drive shaft, said means having an adaptor that mates with said drive shaft and which includes a clearance between the adaptor and the shaft; and a castable material filling said clearance to form an interface between the drive shaft and the adaptor.

14. The electrical switch apparatus of claim 13 wherein said drive shaft is hollow.

15. The electrical switch apparatus of claim 14 wherein said hollow drive shaft is filled with said castable material in the area where said drive shaft and said adaptor mate.

16. An electrical puffer switch apparatus with at least one movable contact and a stationary contact comprising:

at least one chamber surrounding said movable contact and said stationary contact;

a first support means secured within said switch apparatus for supporting said chamber in a fixed position relative to said contacts;

a second support means secured within said switch apparatus for supporting said chamber and said stationary contact in a fixed position within said chamber; and adhesive means for attaching said first and second support means to said chamber.

17. The electrical switch apparatus of claim 16 wherein said adhesive means is an epoxy.

18. The electrical switch apparatus of claim 16 wherein said first support means is a base casting.

19. The electrical switch apparatus of claim 16 wherein said second support means is an end cap.

* * * * *